United States Patent [19]

Gasser

[11] 4,127,920

[45] Dec. 5, 1978

[54] APPARATUS FOR FEEDING A TEXTILE FIBER BAND COMPOSED OF STAPLE FIBERS

[75] Inventor: Hermann Gasser, Zürich, Switzerland

[73] Assignee: Luwa AG, Zurich, Switzerland

[21] Appl. No.: 842,051

[22] Filed: Oct. 14, 1977

[51] Int. Cl.[2] ..... D01H 5/00

[52] U.S. Cl. ..... 19/236; 19/157

[58] Field of Search ..... 19/106 R, 156.4, 156.3, 19/150, 157, 109, 153, 236

[56] References Cited

U.S. PATENT DOCUMENTS

| | | | |
|---|---|---|---|
| 2,262,853 | 11/1941 | Morgan | 19/156.4 |
| 2,608,724 | 9/1952 | Bastin | 19/153 |
| 2,940,133 | 6/1960 | Heritage | 19/156.1 |
| 3,319,302 | 5/1967 | Schmauder | 19/109 X |

*Primary Examiner*—Dorsey Newton

*Attorney, Agent, or Firm*—Werner W. Kleeman

[57] ABSTRACT

Apparatus for textile fiber band or the like composed of staple fibers, wherein the fiber band is guided through a transport tube or duct and there is produced within the transport duct an air flow directed in the same sense as the feed or conveying direction of the fiber band.

6 Claims, 3 Drawing Figures

APPARATUS FOR FEEDING A TEXTILE FIBER BAND COMPOSED OF STAPLE FIBERS

BACKGROUND OF THE INVENTION

The present invention relates to a new and improved method of feeding or conveying a textile fiber band or the like composed of staple fibers and to a new and improved apparatus for the performance of the aforesaid method.

The feeding of textile fiber bands formed of staple fibers which do not possess any or only a weak twist and thus exhibit a low tear strength, such as slivers, roving or threads of a fiber arrangement, to the further processing locations or machines is associated with problems inasmuch as the feed and drawing-in of the fiber bands by means of the mechanical transport elements is time consuming. At the creel of a drawing frame it is necessary for the initial manual drawing-in to lay for instance all of the bands over the rolls to the feed device of the machine.

Furthermore, the piecing together, i.e., the interconnection or twisting of an outgoing band with a new band requires a certain amount of time. Since the modern day machines increasingly operate at ever greater delivery speeds, and furthermore, it is not possible to appreciably increase the size of the cans, this expenditure in time is of ever increasing significance with regard to the can change operation which is required at shorter intervals.

SUMMARY OF THE INVENTION

Hence, it is a primary object of the present invention to provide an improved method of, and apparatus for, feeding a textile fiber band or the like in a manner which effectively solves the aforementioned problems.

Another and more specific object of the present invention aims at the provision of a new and improved method of, and apparatus for, feeding a textile fiber band or the like formed of staple fibers to a processing machine in an extremely efficient, reliable and rapid manner.

Yet a further significant object of the present invention resides in the provision of apparatus for feeding a textile fiber band in a highly efficient, reliable, protective and positive manner, and which apparatus is relatively simple in construction and design, efficient in operation, economical to manufacture, and requires a minimum of maintenance and servicing.

Now in order to implement these and still further objects of the invention, which will become more readily apparent as the description proceeds, the method aspects of the present development are manifested by the features that the fiber band is guided through a transport tube or duct and within such transport tube there is generated an air flow or current which is directed in the same sense as the feed or conveying direction of the fiber band.

It is also within the teachings of the invention to support the band at the end of the transport path, during its separation from the transport air current.

Not only is the invention concerned with the aforementioned method aspects, but as already indicated heretofore, relates to apparatus for the performance thereof, which apparatus is characterized by the features that the feed or conveying path of the fiber band is formed by the transport tube or duct which has a cross-sectional area amounting to a multiple of the cross-sectional area of a given or related fiber band. Further, means are operatively connected with the transport tube in order to generate therein a suction flow.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
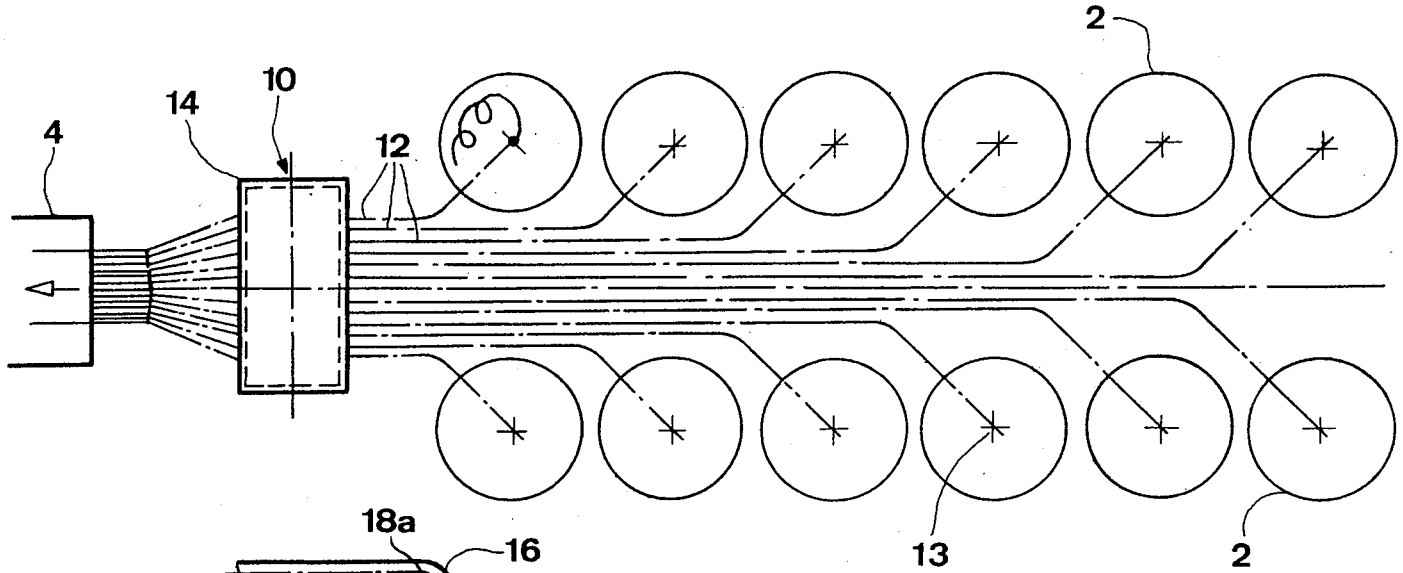
FIG. 1 is a plan view of an exemplary embodiment of apparatus shown in conjunction with the can feed or arrangement of a drawing frame.
Figure 3:
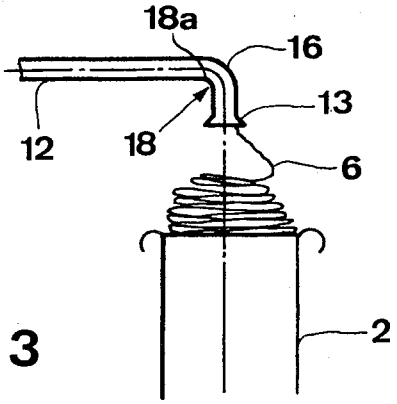
FIG. 3 is a fragmentary view showing the infeed of a fiber band from a can into the tube or duct of the apparatus illustrated in FIG. 1.
Figure 2:
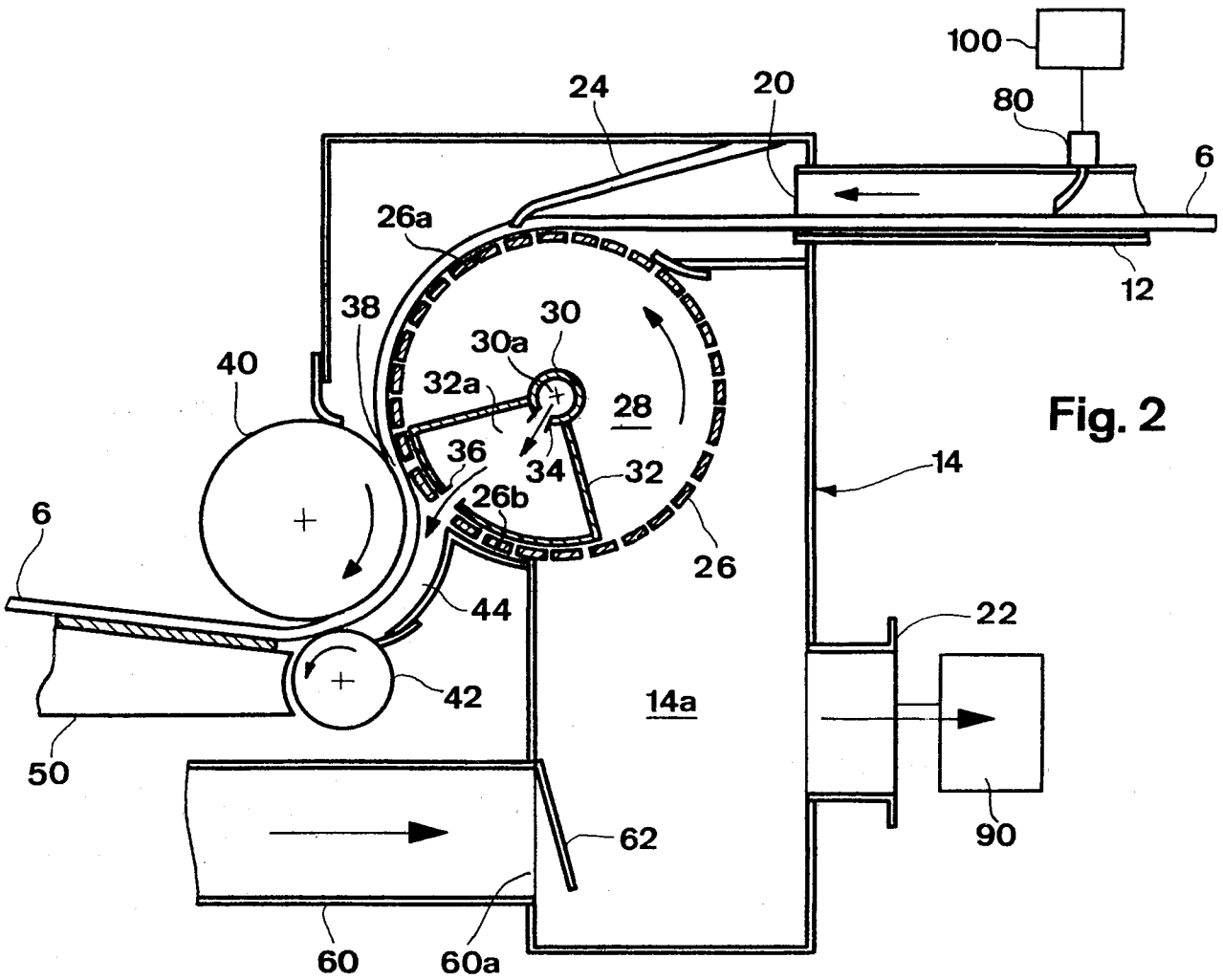
FIG. 2 is an enlarged view, in relation to the illustration of FIG. 1, of the removal box of the apparatus depicted in FIG. 1.

Describing now the drawings, with the exemplary embodiment of apparatus illustrated in FIGS. 1 to 3 there is shown a creel of a drawing frame. Slivers 6 are fed out of a can feed or can arrangement composed of the individual cans 2 pneumatically in the direction of a textile processing machine, here schematically shown as a drawing frame and generally indicated by reference character 4. The apparatus, which has been generally designated by reference character 10, has as its primary components a group of tubes or ducts 12 and a removal or withdrawal box 14 with which all of these tubes 12 communicate, as best seen by referring to FIGS. 1 and 2.

As will be apparent from the illustration of FIG. 3 the inlet openings 13 of the tubes or ducts 12 are each located above a related can 2 and are constructed as downwardly directed tube or pipe bends 16. These bends 16 are equipped at the curved inner side or inner portion 18 with not further illustrated perforations merely schematically indicated by reference character **18*a* and which enable the entry of ambient air into the interior of the related tube or duct 12**.

These tubes or ducts 12, which for instance can be fabricated of any suitable plastic or metal, possess a substantially circular-shaped cross-sectional configuration, and the inner cross-sectional area amounts to a multiple of the cross-section of the largest sliver which is to be transported (FIG. 2).

The slivers 6 which extend through the tubes or ducts 12 and are conveyed therein by a suction air current, enter the removal or withdrawal box 14 at location 20 which constitutes the outlet end or region of the related transport tube or duct 12. Within the chamber or compartment **14*a* formed by the removal or withdrawal box 14 there prevails a negative pressure which is produced by, for instance, the schematically illustrated ventilator 90 which is connected with a connection or stud 22 of the removal box 14. The slivers 6 or the like, after departing from the outlets 20 of the tubes or ducts 12 and while guided by a comb 24, arrive at a sieve drum 26 rotating in counterclockwise direction. This sieve drum 26, in the interior space or chamber 28 of which there is likewise effective the negative pressure, is mounted upon a hollow journal or trunnion 30. Sieve drum 26 is driven by a feed contact roll 40** which cooperates with a driven feed roll 42 at a rotational speed corresponding to the contemplated sliver delivery or feed speed. During such time as the transport air, which flows out of the tubes or ducts 12, flows through the sieve drum 26 the slivers 6 are supported upon the surface 26a of the drum 26 and retained by the comb 24 or equivalent structure at a predetermined path of travel.

The hollow journal or trunnion 30, which flow communicates at its end with the atmosphere, carries a stationary screening body 32. This screening body or screen 32 covers from the inside of the drum 26 an adjustable peripheral portion of the inner surface 26b of the drum 26. As best seen by referring to FIG. 2, the covered portion of the sieve surface 26a of the drum 26 is located opposite the feed contact or pressure roll 40 and an outlet or discharge channel 44. The interior 32a of the screening body 32 flow communicates by means of an opening 34 with the internal space 30a of the journal or trunnion 30 and by means of an opening 36 with the covered sieve surface 26a, again as best seen by referring to FIG. 2. After passing the clamping or nip location 38 between the sieve drum 26 and the feed contact or pressure roll 40 there no longer is effective any contact force upon the slivers 6 and which contact force is directed towards the sieve drum. Instead, the air which in any event flows through the opening 36 towards the inner surface of the sieve drum 26 serves to detach the slivers 6 from the outer surface of such sieve drum. The outfeed of the slivers 6 through the outlet or discharge channel 44, within which there prevails atmospheric pressure, and between the feed roll 42 and the roll 40, is thus favored. The slivers 6 then arrive at the textile processing machine 4 (FIGS. 1 and 3) by means of an infeed or delivery table 50 or equivalent structure.

Continuing, and as best seen by referring to FIG. 2, it is possible to connect the device for applying a suction action to the drawing frame 4 with the removal or withdrawal box 14 by means of a conduit or pipe 60. The part 60a of the pipe 60 which enters the box 14 has operatively associated therewith a suitable shutoff element, here shown as a flap member 62 which can be actuated in any convenient and therefore not further illustrated manner.

This flap member 62 enables placing into operation the apparatus during drawing-in of the slivers 6, whereas the suction action to be exerted at the drawing frame 4, and at the start likewise is still not turned-on, is not yet effective. Accordingly, the flap member 62 is closed during the drawing-in of the slivers 6.

At the neighborhood of the end 20 of a related tube 12 there is provided a feeler 80 which is part of a conventional monitoring device, generally indicated by reference character 100. This monitoring device 100 can stop the drive of the feed roll 42 when there is no longer present any sliver and equally can indicate its condition by generating a suitable signal. Equally the switching-in operation can be accomplished when the start of a sliver 6 has passed the feeler 80.

The transport air current or flow which prevails in the tubes or ducts 12 sucks-up a sliver 6, the starting portion of which is retained at the inlet opening 13 of the related tube or duct 12. For reasons of continuity the same speed or velocity prevails at the start throughout the entire tube. At that location where a sliver 6 blocks part of the tube cross-section the flow speed must be greater than downstream in the free cross-section of the tube, whereby there results the primary feed or conveying of the sliver during the drawing-in operation.

With the sliver drawn-in the speed is adjusted such that, with the cross-section of the related tube or duct slightly blocked (thin location of the sliver), there prevails a lower speed or velocity than at those locations of the cross-section of the tube or duct which are more markedly closed or occupied (thick location of the sliver). Hence, thin sliver locations are thus readily dammed-up than drawn or pulled sliver locations, so that there prevails a practically tensionless feed or transport of the sliver.

The basic tension in the sliver is determined by the sliver weight which freely suspends in front of the suction opening. The free sliver end, upon rupture or depletion thereof, strives to clog the tube or duct. It is dammed-up in an undulated or wave-shaped configuration. To ensure that the sliver does not arrive at the feed or supply roll 42 in this shape, it is held back by the comb 24 and stretched-out.

The monitoring device 100 and its feeler 80 are arranged and structured such that the drawing frame, for instance by reducing the rotational speed of the outgoing sliver end, is still capable of carrying out a drawing or drafting operation just below the comb 24 until the newly applied or infed sliver has reached the sliver end located beneath the comb 24.

By adjusting not particularly illustrated throttle valves or flap members it is possible to accommodate within limits the transport speed to the relevant sliver weight.

In order to facilitate the sucking-up of the starting portions of the slivers it is possible to equip each tube or duct 12 at the neighborhood of the tube end 13 with a not particularly illustrated injector which works in the feed or conveying direction and which remains in operation until the starting point of the sliver has passed the related feeler 80. The injector can be operatively connected with a suitable source of compressed air by means of a controllable shutoff element.

As will be apparent from the preceding description the bands or slivers which are to be transported by means of the apparatus constitute fiber bands formed of staple fibers which do not yet possess any twist and thus have a low tear strength even when formed of larger length staple fibers. Nonetheless it is possible by means of the inventive method to carry out the transport of such bands or slivers without any moved transport elements also over considerably longer distances than those which prevail for instance at a drawing frame, not only without rupture of the sliver or the like but also without any desirable distorted drafts. The transport tubes or ducts can be arranged to extend both horizontally as well as vertically or to ascend or descend.

While there are shown and described present preferred embodiments of the invention, it is to be distinctly understood that the invention is not limited thereto, but may be otherwise variously embodied and practiced within the scope of the following claims. ACCORDINGLY, I claim:

1. An apparatus for feeding a textile fiber band composed of staple fibers, comprising:

means defining a feed path for movement of at least one fiber band in a predetermined direction of travel;

said means defining said feed path comprising a tube having a cross-sectional area amounting to a multiple of the cross-sectional area of a related fiber band moving through said tube;

means operatively connected with said tube for producing a suction flow therein;

a multiplicity of said tubes; said suction flow-producing means defining a common chamber at which terminate said multiplicity of tubes;

said suction flow-producing means including means defining a source of negative pressure operatively connected with said common chamber;

outlet means provided for said common chamber for the delivery of the fiber bands from said common chamber;

means cooperating with said outlet means for supporting the fiber bands;

a plurality of driven rolls provided for said chamber;

at least one of said driven rolls comprising said means for supporting the fiber bands;

means cooperating with said outlet means in order to produce a pressure equalization during such time as the fiber bands are supported by said supporting means;

said one roll comprising a sieve drum; and a stationary guide comb operatively associated with said sieve drum.

2. The apparatus as defined in claim 1, wherein:

said sieve drum has an inner surface;

stationary screen means for covering the inner surface of said sieve drum over a predetermined peripheral region thereof.

3. The apparatus as defined in claim 2, wherein:

said sieve drum has an outer surface;

said screen means has an air outlet opening directed towards the outer surface of said sieve drum; and means flow communicating said air outlet opening with the atmosphere.

4. An apparatus for feeding a textile fiber band composed of staple fibers, comprising:

means defining a feed path for movement of at least one fiber band in a predetermined direction of travel;

said means defining said feed path comprising a tube having a cross-sectional area amounting to a multiple of the cross-sectional area of a related fiber band moving through said tube;

means operatively connected with said tube for producing a suction flow therein;

said suction flow-producing means defining a chamber at which terminates said tube;

said suction flow-producing means including means defining a source of negative pressure operatively connected to said chamber;

outlet means provided for said chamber for the delivery of the fiber band from said chamber;

means cooperating with said outlet means for supporting the fiber band;

said means for supporting the fiber band comprising at least a driven roll arranged within said chamber which is at negative pressure for supporting the fiber band for separating air contained in the fiber band;

a feed contact roll receiving the fiber band from said driven roll and serving for driving said driven roll;

said feed contact roll being positioned at a location along a path of travel of the fiber band which follows said driven roll and at a location where there essentially prevails atmospheric pressure;

a shield arranged within said driven roll for communicating an internal region of said driven roll which is at negative pressure with said location at atmospheric pressure so that the air flow between the region at negative pressure and the location at atmospheric pressure augments the lift-off of the band from the driven roll to the feed contact roll in a gentle and protective manner.

5. The apparatus as defined in claim 4, further including:

a multiplicity of said tubes;

said chamber defining a common chamber at which terminate said multiplicity of tubes.

6. The apparatus as defined in claim 4, further including:

a drafting frame with which cooperates said feeding apparatus.

* * * * *